United States Patent [19]

Hynds

[11] 4,449,858

[45] May 22, 1984

[54] METHODS AND/OR APPARATUS FOR INCREASING THE OVERTURNING RESISTANCE OF RETAINING WALLS

[75] Inventor: John R. Hynds, Auckland, New Zealand

[73] Assignee: J. R. Hynds Limited, Auckland, New Zealand

[21] Appl. No.: 390,371

[22] Filed: Jun. 21, 1982

[30] Foreign Application Priority Data

Jun. 24, 1981 [NZ] New Zealand ..... 197519

[51] Int. Cl.[3] ..... E02D 17/00

[52] U.S. Cl. ..... 405/286; 405/284; 405/272

[58] Field of Search ..... 405/284–287, 405/15, 16, 28–32; 52/589, 590

[56] References Cited

U.S. PATENT DOCUMENTS

| | | | |
|---|---|---|---|
| 3,464,211 | 9/1969 | Andresen | 405/262 |
| 3,922,864 | 12/1975 | Hilfiker | 405/286 X |
| 4,081,969 | 4/1978 | Clarke | 405/286 |
| 4,193,718 | 3/1980 | Wahrendorf et al. | 405/286 |
| 4,266,890 | 5/1981 | Hilfiker | 405/262 X |

FOREIGN PATENT DOCUMENTS

| | | | |
|---|---|---|---|
| 747703 | 4/1933 | France | 405/287 |
| 0607891 | 5/1978 | U.S.S.R. | 405/284 |

*Primary Examiner*—Dennis L. Taylor

*Attorney, Agent, or Firm*—Holman & Stern

[57] ABSTRACT

A plurality of interlinking restraining members are interconnected to each other and the ends connected respectively to a deadman and to a retaining wall, e.g. a crib wall, to increase the resistance to overturning of the wall. The interlinking members are generally C shaped and formed of reinforced concrete.

6 Claims, 6 Drawing Figures

1
2
3
3'
4
5
5'
6
7
8
9
10
20
21
25
26
30
52

METHODS AND/OR APPARATUS FOR INCREASING THE OVERTURNING RESISTANCE OF RETAINING WALLS

BACKGROUND OF THE INVENTION

1. Field of the Invention

This invention relates to methods and/or apparatus for increasing the overturning resistance of retaining walls and has been devised particularly though not solely for use with crib walls.

2. Brief Summary of the Invention

It is an object of the present invention to provide a method of and/or apparatus for increasing the resistance to overturning of retaining walls.

Accordingly in one aspect the invention consists in a method of increasing the resistance to overturning of a retaining wall including the steps of applying to the retaining wall intermediate of its height a plurality of discrete interlinking members, attaching a first interlinking member to the retaining wall intermediate of the height thereof and a last interlinking member to a deadman.

In a further aspect the invention consists in interlinking restraining means for increasing the resistance to overturning of a retaining wall, said interlinking restraining means including a plurality of interconnected, interlinking members one end of the plurality of members being attached to a retaining wall intermediate of its height and the other end being attached to a deadman.

In a still further aspect the invention is in a method of increasing the resistance to overturning of a retaining wall, including the steps of applying to the retaining wall intermediate of its height a plurality of discrete interlinking members, attaching a first one of the interlinking members to the retaining wall intermediate of the height thereof and to a last one of interlinking members, a deadman.

To those skilled in the art to which this invention relates, many changes in construction and widely differing embodiments and applications of the invention will suggest themselves without departing from the scope of the invention as defined in the appended claims. The disclosures and the descriptions herein are purely illustrative and it is not our intention to limit the scope of the invention by those disclosures and descriptions, or otherwise, than by the terms of the appended claims.

BRIEF DESCRIPTION OF THE DRAWINGS

One preferred form of the invention will now be described with reference to the accompanying drawings.

DETAILED DESCRIPTION

Figures 1, 2:
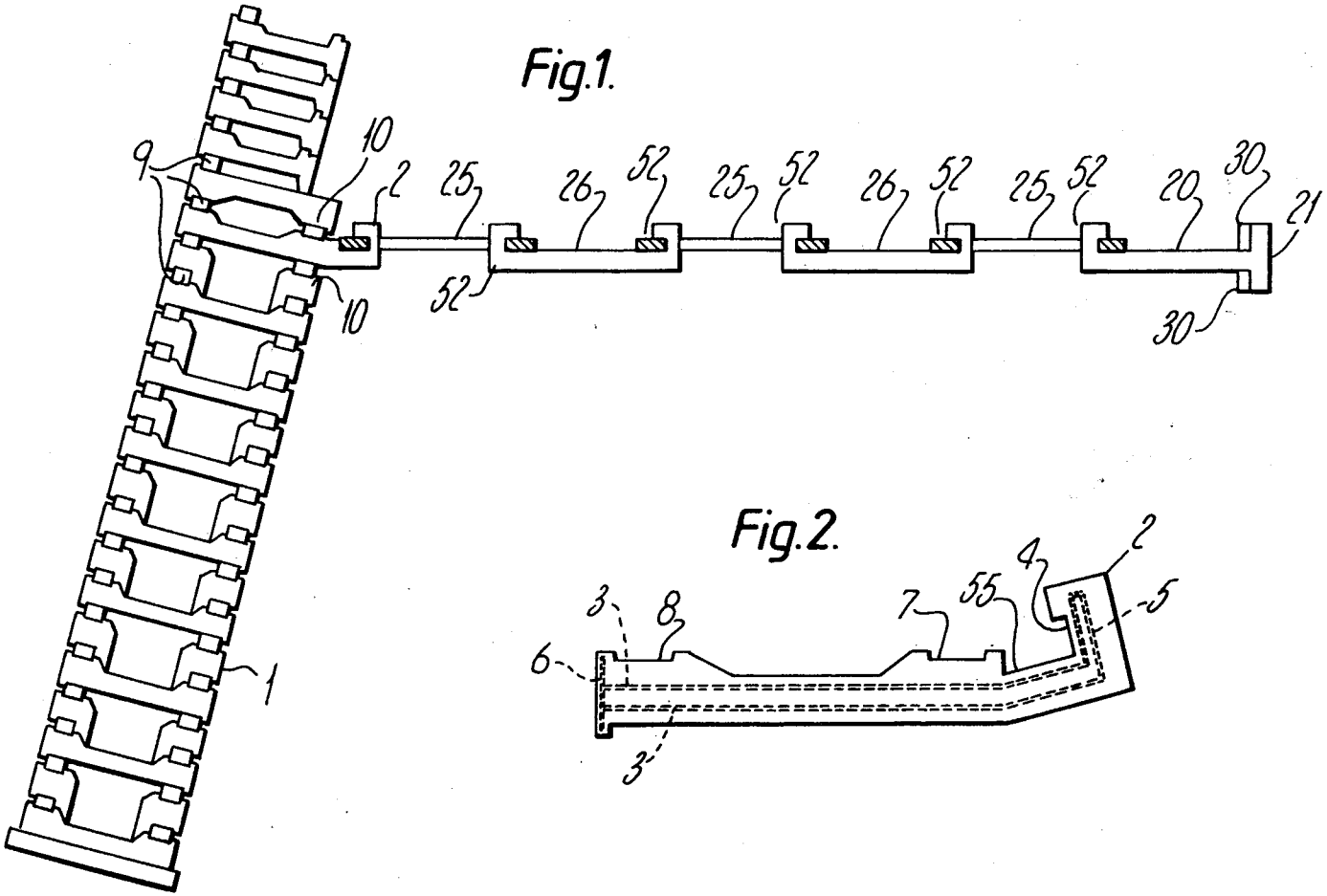
FIG. 1 is a diagrammatic cross section of part of a retaining wall in the form of a crib block wall having an overturning resisting means according to the invention associated therewith.
FIG. 2 is a schematic view of a crib wall header block having hook means and showing the reinforcing therein.

Referring to the drawings an overturning resisting means for assisting in resisting the overturning of a retaining wall, in particular a crib wall, will now be described.

The crib wall 1 in FIG. 1 is made of stretchers, headers and false headers in the known way up to the height of a hooked block 2 and of headers and stretchers thereabove. The hooked block 2 is shown more particularly in FIG. 2 and has reinforcing therein comprising longitudinal tendons 3 arranged to reinforce a hook 4 by parts of the reinforcing being extended as at 5. Transverse reinforcing is provided at 6 and preferably at 7, though the reinforcing at 7 may not be necessary. The block has a depression 8 in which stretchers 9 are placed and similar stretchers 10 are placed at the rear of the lower portion of the crib wall. To provide resistance or add to resistance to overturning discrete interlinking means in the form of hooked block members 15 are provided, such blocks having hooks 16 at each end and a longitudinal intermediate portion 17.

Figure 4:
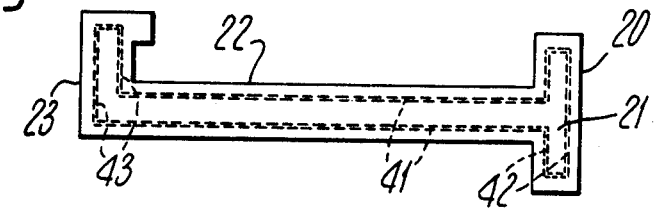
FIG. 4 is a schematic side elevational view of the last in a series of interlinking means.

In FIG. 4 there is shown a terminal tension member 20 having a T member 21 at one end of the longitudinal member 22 and a hook 23 at the opposite end.

Figure 5:
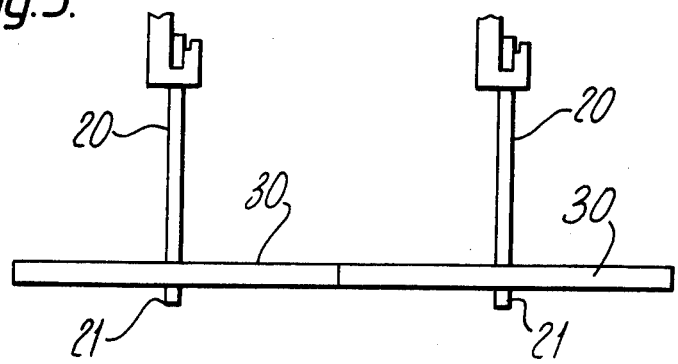
FIG. 5 is a schematic plan view of deadmen connected to the resisting means.
Figure 6:
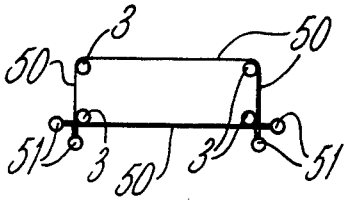
FIG. 6 is a schematic view showing the arrangement of reinforcing in the block of FIG. 2.

The blocks 15 are positioned as shown in FIG. 1, alternately upright and lying on the side, thus the first block 25 is shown on its side the next block 26 upright, and so on and thus the blocks positions are alternated at 25 and 26 as shown. Finally a terminal block 20 is positioned vertically. Stretcher blocks 30 are positioned one above the other as may be seen in FIGS. 1 and 5 against the T head 21 of the terminal block 20 to form deadmen i.e. beams substantially parallel to the crib wall 1.

Figure 3:
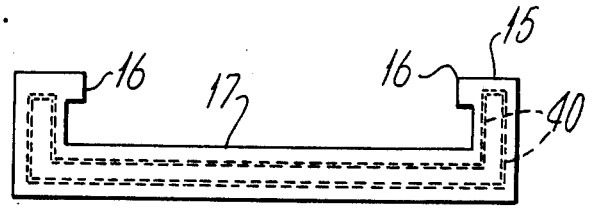
FIG. 3 is schematic side elevational view of a discrete interlinking means.

Reinforcing is provided in the hooked members 15 and member 20 and such reinforcing may be provided in what might be described as formed shape 40 as in FIG. 3 or alternatively welded rods 41,42 and 43 may be interconnected as shown in FIG. 4. The blocks of FIG. 2 may be formed into a rectangular arrangement supported by stirrup members 50, the stirrup members having plastic ends 51 as desired to position the members against the forms.

The blocks of FIG. 2 may be produced in molds which have removable pieces so that the slightly complicated form can be satisfactorily removed. In particular a removable member may be fitted in space 55 and the walls of that space may be sloped slightly to provide draw enabling withdrawal of the removable mold piece. Of course other alternatives are possible.

It can be seen from the foregoing that a tension means is provided which will resist overturning of the crib wall 1 and thus add strength against overturning in a simple yet economical way. In particular where the crib wall is to be erected against a relatively solid earth bank i.e. one which has not been disturbed, considerable excavation savings can be provided since the only alternative is to provide a double crib wall in lower areas of the bank to be retained, which requires a large amount of unnecessary digging and has a further disadvantage of disturbing soil which otherwise need not be disturbed.

It is to be noted that the tension restraining means is arranged in a horizontal plane and this is advantageous again since it reduces the amount of digging necessary to place the tensioning means in position.

The stretchers 30 acting as deadmen do not need further restraint since they will be firmly fixed in position preferably against undisturbed soil and any twisting will be restrained by earth resistance and therefore likley to be immaterial.

The ends 52 of the links 15 also bear against soil and add to the overturning resistance.

The invention may also be used to increase the resistance to overturning of retaining walls other than crib walls, e.g. Modular panel walls or cast in situ walls. In such cases slots either T shaped or rectangular are provided in the walls at intervals and Tee or bulbous headed blocks similar to the blocks so mounted therein by placing the head of block in the cross bar of a Tee shaped hole then moving the block into the stem of the hole or by passing the head of the block 20 through a rectangular hole and rotating it through 90° to take up a locked disposition.

What is claimed is:

1. Restraining means for increasing the resistance to overturning of a crib retaining wall comprising, a restraining header adapted to be incorporated in said crib wall as a part thereof intermediate the height of said wall, a hook member integral with said restraining header and extending outwardly therefrom in the direction of restraining, a plurality of interlinking block members each comprising hook shaped end portions interconnected by a longitudinal intermediate portion, said hook ends of said block members being interlinked to form an elongated chain of said interlinking block members and the free hook at one end of said chain being interlinked with said hook member on said restraining header, a deadman adjacent the other end of said chain of interlinking block members, and means to connect the free hook at said other end to said deadman.

2. A restraining means as claimed in claim 1 wherein said means to connect the free hook at said other end to said deadman comprises a longitudinal terminal block member having a hook shaped portion at one end and a Tee bar portion at the other end, said hook portion of said terminal block being interlinked with said free hook at said other end of said chain of interlinking members and said Tee bar portion being interconnected with said deadman.

3. A restraining means as claimed in claim 2 wherein said hook shaped end portion comprises a first straight element extending substantially perpendicular from said longitudinal intermediate portion and a second straight element extending substantially parallel to said longitudinal portion, and said chain comprises adjacent interlinking block members being positioned substantially perpendicular with respect to each other.

4. A crib retaining wall structure comprising, a plurality of stacked headers and stretchers forming a crib wall, a restraining header incorporated in said crib wall as a part thereof intermediate the height of said wall, a hook member integral with said restaining header and extending outwardly therefrom in the direction of restraining, a plurality of interlinking block members each comprising hook shaped end portions interconnected by a longitudinal intermediate portion, said hook ends of said block members being interlinked to form an elongated chain of said interlinking block members and the free hook at one end of said chain being interlinked with said hook member on said restraining header, a deadman adjacent the other end of said chain of interlinking block members, and means to connect the free hook at said other end to said deadman, so that said interlinking block members and said deadman increase the resistance to overturning of said crib wall.

5. A retaining wall structure as claimed in claim 4 wherein said means to connect the free hook at said other end to said deadman comprises a longitudinal terminal block member having a hooked shaped portion at one end and a Tee bar portion at the other end, said hook portion of said terminal block being interlinked with said free hook at said other end of said chain of interlinking members and said Tee bar portion being interconnected with said deadman.

6. A retaining wall as claimed in claim 5 wherein said hook shaped end portion comprises a first straight element extending substantially perpendicular from said longitudinal intermediate portion and a second straight element extending substantially parallel to said longitudinal portion, and said chain comprises adjacent interlinking block members being positioned substantially perpendicular with respect to each other.

* * * * *